148-139 AU 111 EX
9/16/80 XR 4,222,793

United States Patent [19]
Grindahl

[11] 4,222,793
[45] Sep. 16, 1980

[54] HIGH STRESS NODULAR IRON GEARS AND METHOD OF MAKING SAME

[75] Inventor: Robert B. Grindahl, Saginaw, Mich.

[73] Assignee: General Motors Corporation, Detroit, Mich.

[21] Appl. No.: 17,840

[22] Filed: Mar. 6, 1979

Related U.S. Application Data

[63] Continuation of Ser. No. 856,391, Dec. 1, 1977, abandoned, which is a continuation-in-part of Ser. No. 772,745, Feb. 28, 1977, abandoned.

[51] Int. Cl.[2] ..... C21D 5/00; C22C 37/00
[52] U.S. Cl. ..... 148/2; 148/35; 148/39; 148/139; 148/141
[58] Field of Search ..... 148/2, 3, 4, 35, 39, 148/138, 139, 141, 147; 75/123 CB; 29/90, 159.2, DIG. 36; 72/53

[56] References Cited

U.S. PATENT DOCUMENTS

| | | | |
|---|---|---|---|
| 2,796,373 | 6/1957 | Berg | 148/139 |
| 3,414,442 | 12/1968 | Greenwood et al. | 148/35 |
| 3,784,416 | 1/1974 | Davies | 148/141 |
| 3,860,457 | 1/1975 | Vourinen | 148/141 |

FOREIGN PATENT DOCUMENTS

| | | | |
|---|---|---|---|
| 2141176 | 2/1973 | Fed. Rep. of Germany | 148/16.6 |
| 512244 | 8/1939 | United Kingdom | 148/2 |

OTHER PUBLICATIONS

Angus, H. T., "Physical and Engineering Properties of Cast Iron", British Cast Iron Research Association, Alvechurch, Birmingham, England, 1960.

Almen, J. O., "Peened Surfaces Improve Endurance of Machine Parts", Metals Progress, Feb., 1943, pp. 209–215, 270.

*Metals Handbook,* 1948 Edition, ASM, pp. 248–250.

"Shot Peening", 3rd Ed., 1947, American Wheelabrator & Equip. Corp., pp. 165–167.

*Primary Examiner*—L. DeWayne Rutledge
*Assistant Examiner*—Peter K. Skiff
*Attorney, Agent, or Firm*—Lawrence B. Plant

[57] ABSTRACT

High stress, acicular bainitic, nodular iron gears having residual compressive stresses at the surface of the teeth's roots of at least about 40,000 psi and a subsurface residual compressive stress of about 10,000 psi at a depth between about 0.006 inch and 0.015 inch beneath the surface. Method for making gears including: casting nodular iron blank; heating blank to ferritize its microstructure prior to cutting teeth into the blank; heating it in a nonoxidizing environment to an austenitic phase dissolved-carbon-content of about 0.7% to about 1.1%; rapidly quenching the austenitized casting to an acicular-bainite-forming isothermal transformation temperature; isothermally transforming the austenite at that temperature to at least 50% acicular bainite before cooling; and shot peening at least the roots of the teeth to impart the residual compressive stresses thereto.

6 Claims, 4 Drawing Figures

HIGH STRESS NODULAR IRON GEARS AND METHOD OF MAKING SAME

BACKGROUND OF THE INVENTION

Figure 1:
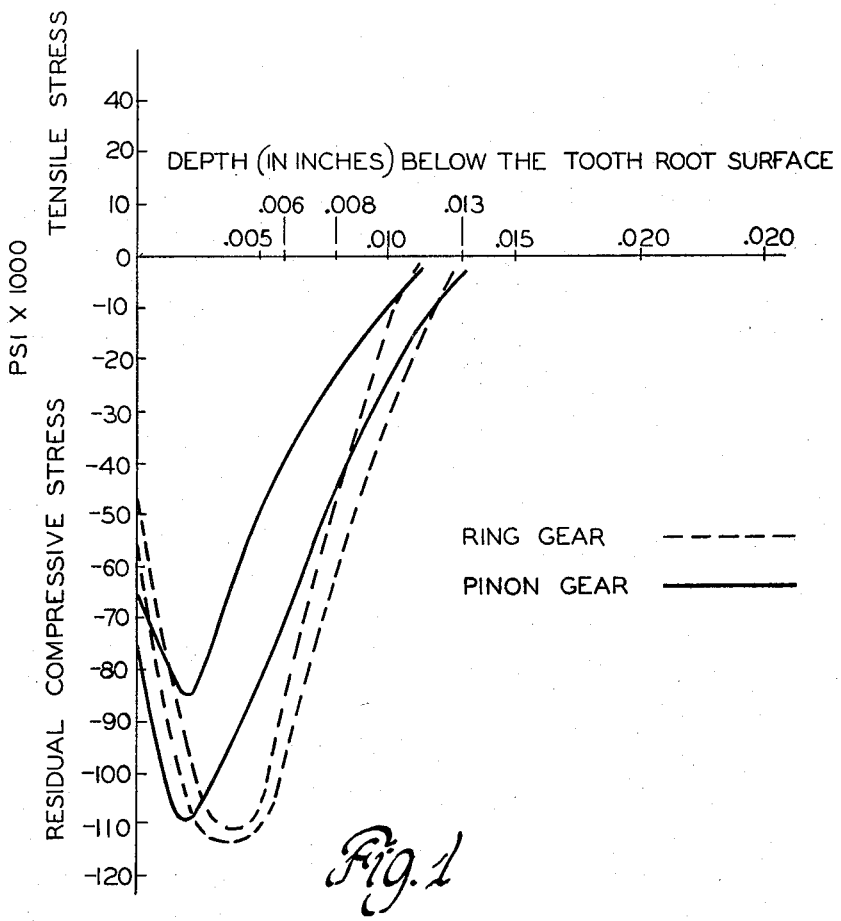

This is a continuation of application Ser. No. 856,391 filed on Dec. 1, 1977, abandoned, which in turn is a continuation-in-part of Ser. No. 772,745 filed Feb. 28, 1977, abandoned.

This invention relates to high stress gears made from nodular iron. More particularly, this invention relates to gears comprising nodular iron with a cold worked, highly compressively stressed surface and subsurface skin formed at least at the root of each gear tooth (i.e., the valley between teeth where no contact is made with mating teeth). Preferably, the stressed skin is formed over the entire contacting surface of the tooth as well. By high stress gears is meant gears which routinely withstand applied tensile stresses of up to about 7,000 psi at the surface of the teeth near their roots (i.e., hereafter tooth root surface stress) and occasionally applied tensile stresses of at least about 60,000 psi at the surface of the teeth near their roots.

Gears are made in various sizes and from various materials, weak and strong. The material selected for any particular gear is chosen based on the particular service the gear is expected to experience. As a general rule, the strength of the material used in making the gears increases as the load the gear is to experience in service increases. Hence, large gears destined for low load (i.e., force applied to each tooth at the interface with the mating gear tooth) service may be made from relatively weak materials (including nodular iron) since the roots of the teeth never experience high stresses. Similarly, small gears subjected to large loads are made from strong materials as the roots of the teeth experience extreme stresses. Experience has shown that a common failure mode for gears results from fatigue characterized by the formation of cracks at the surface of the tooth at its roots which cracks propagate inwardly and eventually cause the breaking off of the tooth or a portion thereof. This failure mode occurs when the material chosen is inadequate to meet the service needs of the gear. This particular failure mode, for example, is quite common in automotive drive gear sets of the spiral bevel or hypoid type which are relatively small in proportion to the loads they see, and where the pinion gear teeth routinely see tooth root surface tensile stresses of up to about 3,000 psi during normal driving, and occasional tooth root surface stress excursions of more than about 73,000 psi under rapid load applications, and the ring gear teeth routinely see tooth root surface tensile stresses of up to about 7,000 psi during normal driving, and occasional tooth root surface stress excursions of more than about 90,000 psi under rapid load applications. Because of the severity of the service these gears see, they have typically been made from case hardened (i.e., carburized) forged steel. Carburized steel gears, however, are costly, heavy, and difficult to machine, carburize and hold dimensions in subsequent post-carburizing heat treatment steps (e.g., quenching). Regardless of these disadvantages, the automotive industry has relied virtually entirely of their stength, hardness and proven reliability for such applications.

It is an object of the present invention to provide a nodular iron gear and method of making same which is cheaper, lighter, quieter, more score resistant, more easily machined and more readily controlled (i.e., dimension-wise) during heat treatment than the traditional carburized steel gear without sacrificing any of the durability and performance of the traditional steel gear in high stress applications (i.e., automotive drive-line hypoid gears). This and other objects of the present invention will become more readily apparent from the detailed description thereof which follows.

FIG. 1 is a plot of the residual compressive stress vs. the depth beneath the surface of the tooth root for a typical automotive hypoid gear set made in accordance with this invention. The stresses reported thereon were determined essentially according to the X-ray method and apparatus techniques disclosed in United States Pat. No. Weinman 3,402,291, issued Sept. 17, 1968.

Figure 2:
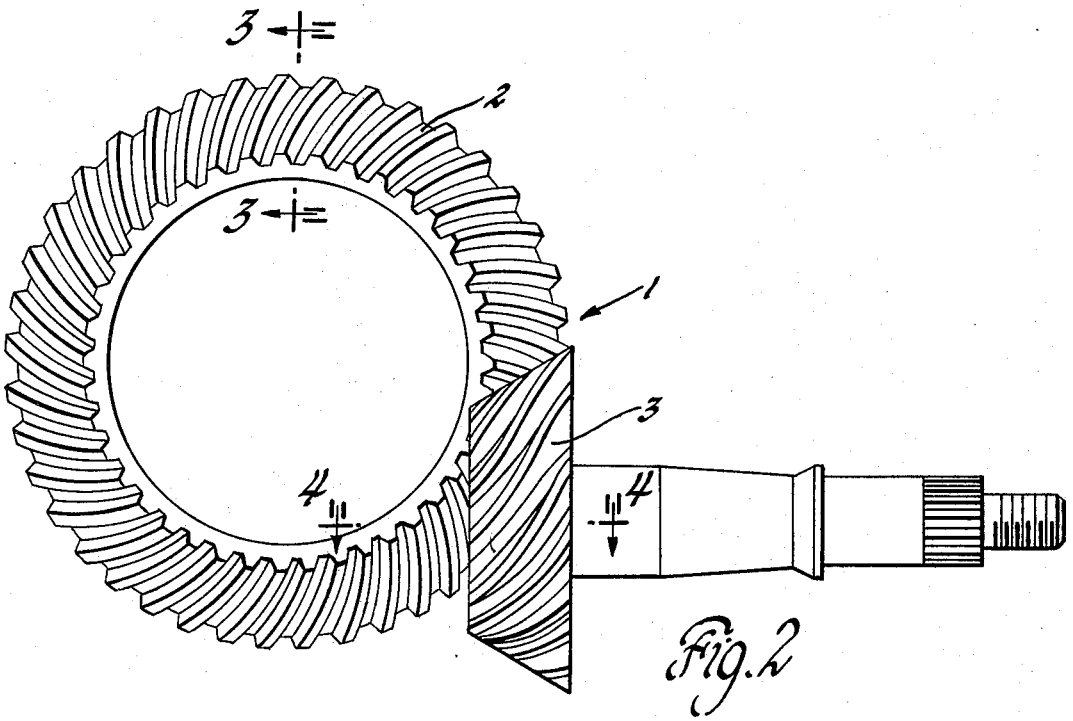

FIG. 2 is a side elevational view of an automotive drive hypoid gear set made in accordance with the present invention.

Figure 3:
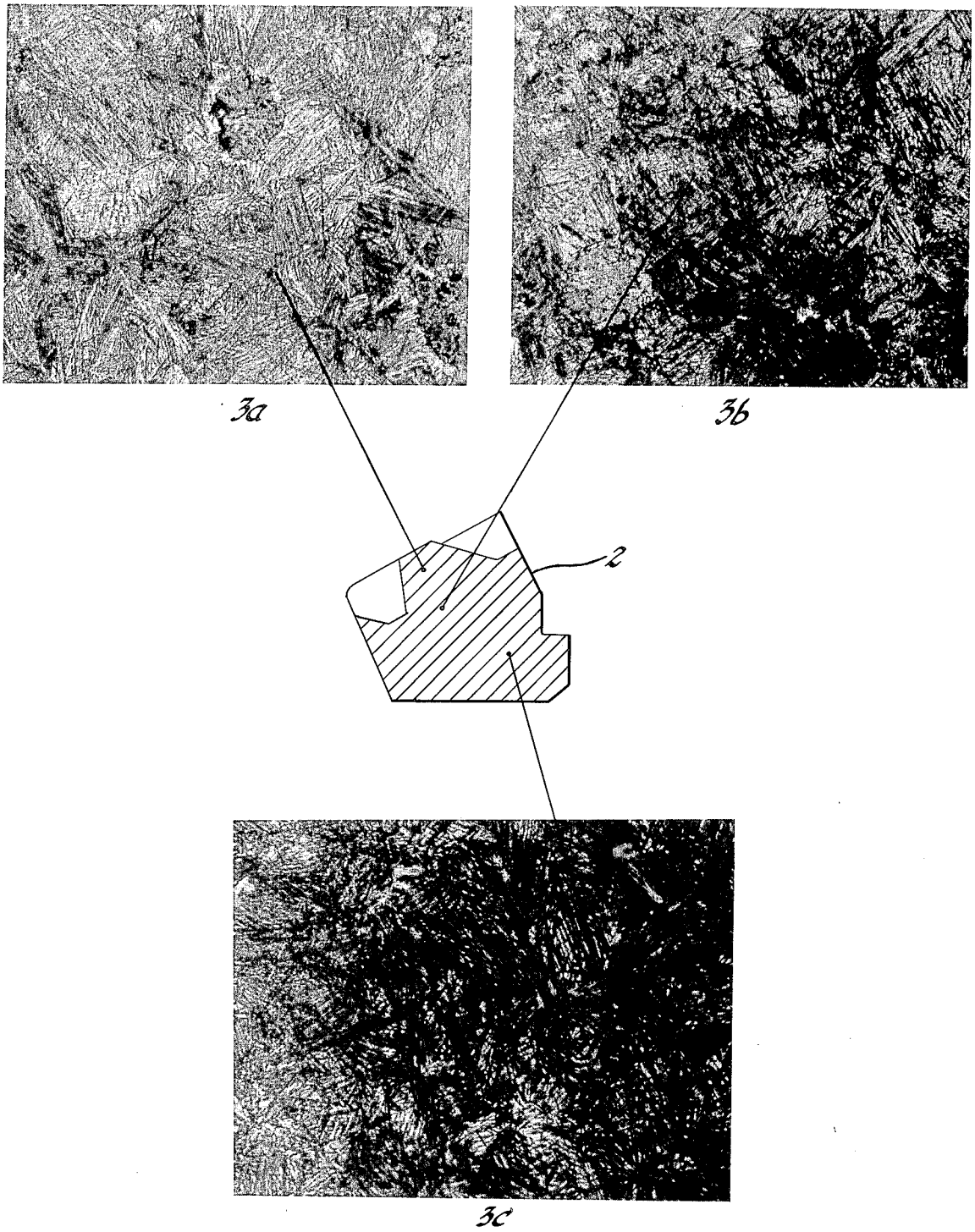
Figure 4:
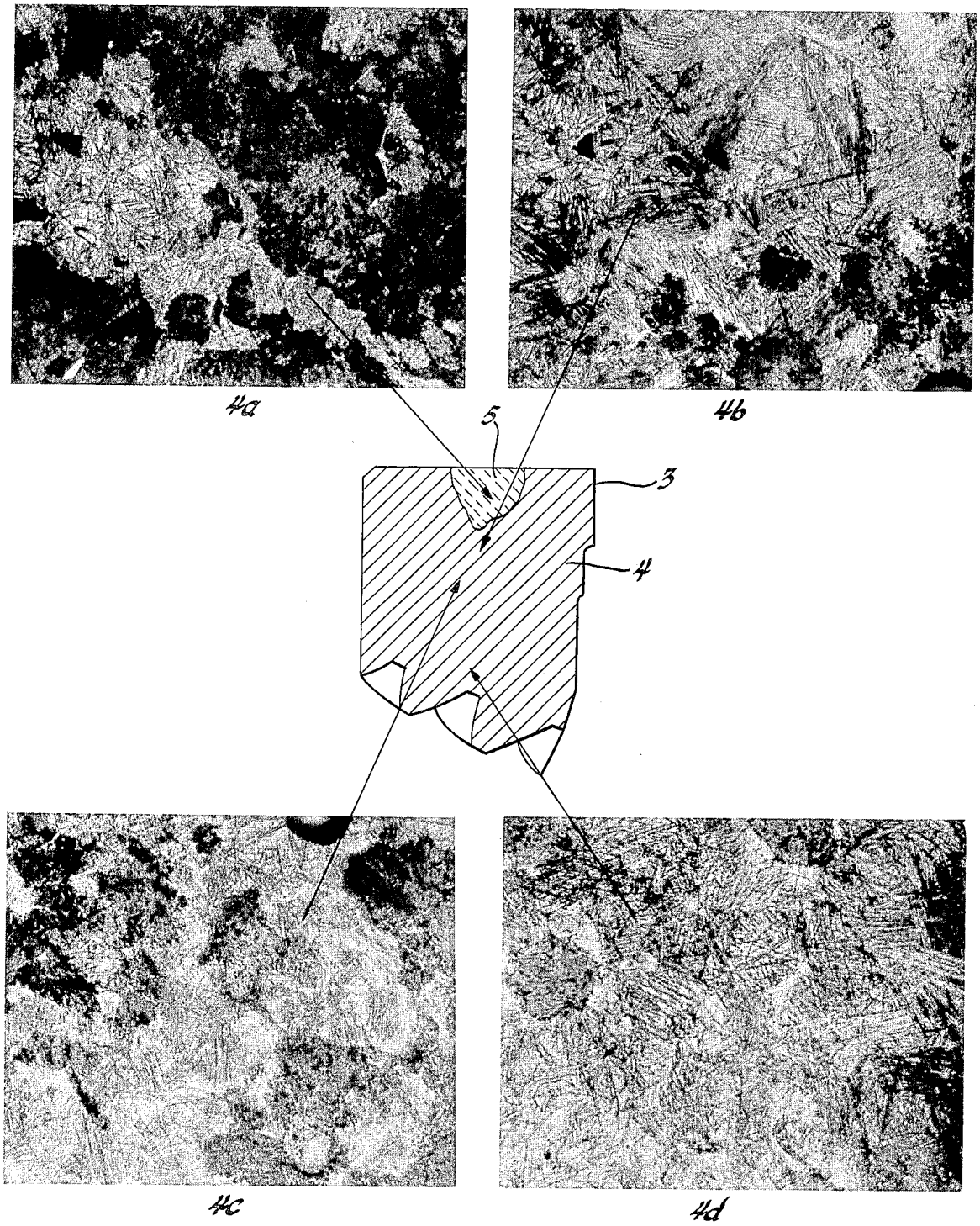

FIG. 3 is a section taken in the direction 3—3 of the ring gear of FIG. 2 and showing the microstructure (500× +2% Nital etch) thereof at various locations 3*a*, 3*b* and 3*c* of its cross section; and FIG. 4 is a section taken in the direction 4—4 of the pinion gear of FIG. 2 and showing the microstructure (500× −2% Nital etch) thereof at various locations 4*a*, 4*b*, 4*c* and 4*d* of its cross section.

This invention comprehends a through hardened, surface stressed nodular iron gear having a matrix comprising principally (i.e., more than 50%) acicular bainite which has a dissolved carbon content of about 0.7 to about 1.1% (preferably 0.8% to 1.0%), and a Vickers diamond pyramid hardness number of about 577 to about 720 (preferably 613 to 720). Preferably, the gear comprises at least about 65% acicular bainite as the matrix to insure high impact and fatigue strengths in the gear. As the acicular bainite falls below about 65% the gear becomes increasingly brittle and less capable of withstanding high applied impact loads and below about 50% bainite the impact strength is at an unacceptably low level for high stress applications. Ideally, the structure would comprise upwards of 90% to 100% of the bainite for even better impact strength, but the economics associated with the prolonged cooling required to achieve that level is not seen to be justified for most applications. When the dissolved carbon content falls below about 0.7% the bainite matrix is considered too soft for wear and scoring resistance, and when it exceeds about 1.1%, too brittle for many high stress applications. Preferably, the dissolved carbon content is between 0.8 and 1.0 because it results in the most desirable combination of hardness and impact strength. Moreover, when the hardness falls below about 577 and above about 720 Vickers, the tensile strength is considered too low for most high stress applications. The preferred 613 to 720 Vickers range appears to be the optimum tensile strength-wise.

A high residual compressive stress is cold worked (preferably by shot peening) into the surface of the gear at least at the base or root of each tooth to mitigate the inservice tooth root tensile stress applied thereat. As a practical matter and to avoid the need to tediously mask the gears, the contacting surfaces of the teeth are also stressed during peening. More specifically, a compressively stressed skin (e.g., about 0.005 inch to 0.020 inch) is formed at the base or root of each tooth to resist the aforesaid initial crack formation and propagation, and to provide long service life for the gear. The residual compressive stress pattern at and beneath (e.g., about 0.006 inch to 0.015 inch) the surface is important. In this regard, shot peening the surface to induce the compressive stress necessarily imparts a higher stress at or near the surface which progressively decreases as the depth beneath the surface (i.e., subsurface zones) increases. Similarly in the preferred embodiment where the entire tooth is peened (i.e., impingement cold worked) the contacting surfaces of the teeth located above the roots are stressed more than at the root for a given level of root stressing. It has been observed that the tooth root residual compressive stress at the surface should be at least about 40,000 psi, but not more than about 85,000 psi. Moreover, it has further been observed that that residual compressive stress should generally fall off at such a rate as to yield a residual compressive stress of about 10,000 psi between about 0.006 inch and 0.015 inch (preferably 0.008 to 0.013 inch) beneath the surface. It is recognized (i.e., see FIG. 1) that there is normally an increase in residual compressive stress slightly below the surface as compared to the actual surface itself, but this is not considered to be significant as far as the tooth root surface stresses are concerned, but is important as far as the stressing of the contacting surfaces is concerned as will be pointed out hereinafter. Generally speaking, it has been observed that when the residual compressive surface stress falls below about 40,000 psi at the tooth root it is insufficient to mitigate the applied tensile stress for most high stress gear applications. When it exceeds about 85,000 psi, (i.e., for the preferred embodiment in which the entire tooth's surface is compressively stressed) there is a tendency for the tooth to spall or pit where it contacts the mating teeth. Accordingly, this invention comprehends that the tooth root surfaces be stressed to at least about 40,000 psi, and in the preferred embodiment, that the tooth root surfaces be stressed no more than about 85,000 psi. Moreover, the compressive stress at the tooth root should decrease with increasing depth such that between about 0.006 inch and 0.015 inch beneath the surface the residual stress is about 10,000 psi. In this regard, were the stress only about 10,000 psi at less than about 0.006 inch, early fatigue failure would likely occur due to overstressing the material therein, since the resultant stresses at this shallow a depth can still exceed the strength of the material and cause an internal fracture. Moreover, when the 10,000 psi level occurs at depths greater than about 0.015 there is a tendency for mating teeth to spall or pit where they contact one another.

Gears made in accordance with the present invention are made by a unique combination of metallurgical techniques combined to achieve the above results in a most efficient and economical manner. In this regard, a gear blank (i.e., a form having the general overall shape of the desired gear) is cast from nodular iron which typically comprises about 3.2% to about 4.1% total carbon, about 1.8% to about 3.0% silicon, about 0.1% to about 0.8% manganese and the balance principally iron.

Following casting, the blank is heated hot enough and long enough to dissolve as much of the hard combined carbon (i.e., cementite) as possible. This is essentially an annealing operation designed to soften the casting for subsequent machining operations, and generally homogenize its microstructure so that growth in subsequent heat treatments is controllable and predictable. When the casting contains more than about 3% nonpearlitic cementite, I prefer to heat the casting above the eutectoid temperature which ranges from about 1333° F. to about 1480° F. depending on the heating rate and the precise composition of the metal. I prefer to heat it to a temperature of between about 1550° F. to 1700° F. to austenitize the casting and dissolve the nonpearlitic cementite. A protective atmosphere may be used especially at the higher temperatures to reduce any oxidation of the surface. It is then slowly cooled through the eutectoid temperature range to yield a uniform structure. Preferably, the casting is cooled at a rate of no more than about 100° F. per hour to yield a casting containing 65% or more ferrite. Most preferably, the casting would contain as much as 95% ferrite for maximum machinability and increased tool life during the tooth cutting operations. This is particularly important when using high speed tool steels for the tooth cutting operations. With the harder tools (e.g., carbides) much higher pearlite contents can be tolerated even to the point of an all pearlitic structure. However, the ferritizing is preferred to insure maximum tooling economics. When the casting contains less than about 3% nonpearlitic cementite, the same result can be achieved by a lower temperature heating, i.e., below the eutectoid temperature range and holding it at that temperature for a sufficiently long time to insure decomposition of the pearlitic combined carbon. This latter technique has the advantage of lower fuel costs, but may require longer treatment times at the lower subcritical temperatures, and in this light it is not considered practical to perform a subeutectoid temperature anneal below about 1100° F. From a production standpoint all the castings should be annealed to the same ferrite level so that growth and tool life expectancy can be consistently predicted.

Following cooling the casting is generally machined (i.e., blanked). In this machining allowance is made for a growth rate of about 0.003 inch per inch expected to result in subsequent heat treatments. Then the teeth are cut into the blank according to conventional practice (e.g., using Gleason gear milling and generating machines). With the preferred highly ferritic nodular iron gear blanks tool (i.e., high speed steel) life improvements (i.e., over steel gears) of as much as 1290% have been achieved for automotive differential ring gear roughing and as much as 575% for automobile differential drive pinion gear roughing over their steel counterparts.

The tooth contact development for nodular iron gears, as with heat treated steel gears, is a trial and error procedure. That is, the heat treatment changes of a given tooth incident to its particular growth characteristic are determined, the adjustments are then made in the machining operation to compensate for these changes. Ultimately, the tooth cutting machine settings are developed which provide mating gears with a tooth contact pattern that, after lapping, results in a quiet gear set.

Following the machining of the teeth, the gears are heated in a substantially nonoxidizing atmosphere (i.e., preferably nitrogen) to a temperature between about 1600° F. and 1700° F. for a time sufficient to dissolve carbon from the graphite nodules and any combined carbon present and form an austenitic phase containing about 0.7% to about 1.1% dissolved carbon. This is preferably accomplished by heating the gears to about 1650° F. and holding them there for about 3.5 hours. Because the nodular iron is a high carbon content material it is not only lighter than steel (i.e., almost 10% lighter) but there is no need to provide a high carbon potential atmosphere during this austenitizing portion of the cycle. It is important, however, to prevent decarburization of the surface in order to insure that a hard wear resistant surface is maintained on the gear. It is likewise important to restrict the oxidation of silicon and manganese as loss of these elements decreases the hardenability of the iron and may result in the formation of some free ferrite and upper bainite at the surface of hard to quench sections. For these reasons substantially nonoxidizing atmospheres are used. A preferred such atmosphere is a low dew point nitrogen generated from burning natural gas. Here again economies are achieveable by the present process for to stoichiometrically-produce 1000 cubic feet of atmosphere for hardening the nodular iron requires only 135 cubic feet of natural gas as compared to about 450 cubic feet for a carburizing atmosphere. Vaporized liquid nitrogen, argon, etc. and even a carbon-equilibrated carburizing atmosphere could be used here successfully.

Following austenitizing, the gears are quenched at a rate so as to avoid the nose of the time-temperature transformation curve of the nodular iron (i.e., at least about 66° F. per second) to an isothermal transformation temperature of above about 425° F. but below about 650° F. This rapid quenching to the selected isothermal transformation temperature minimizes the formation of significant amounts of pearlite, feathery bainite or martensite prior to and during the subsequent isothermal transformation that is to follow. The gears are held at the isothermal transformation temperature for a time sufficient to convert the austenite to at least 50% and preferably 75% or more acicular bainite. By way of example, castings are austenitized at 1650° F. and preferably quenched in oil (i.e., flashpoint 510° F.) to about 445° F. and held thereat for about two hours or more to convert most (i.e., about 75%) of the austenite to acicular bainite with the balance being some martensite and retained austenite principally formed during subsequent cooling. This form of heat treatment is essentially that which is known as "interrupted austempering". The gears are then cooled to room temperature.

Through hardened gears so made have demonstrated hardness equivalents of about 56 to 61 Rockwell C. excellent impact strengths and scoring resistance. Unlike carburized steel gears which have a residual compressive surface stress formed therein as a direct result of the carburization process, nodular iron gears leave the aforesaid heat treatment with a residual tensile stress at the surface. In order to achieve fatigue life from the nodular iron equivalent to carburized steel, it is necessary to reduce the resultant stress that each tooth root will see in service. The resultant stress can be minimized by removing the aforesaid inherent residual tensile stress and imparting to the roots of the teeth (i.e., which experience the highest bending stresses) a high residual compressive stress. This is done by shot peening the surface in accordance with accepted practices to achieve the aforesaid residual compressive stresses. For example, in the preferred gears which have been through hardened by the interrupted austempering process cycle described above, the 40,000 psi to 85,000 psi residual compressive surface stresses and the 10,000 psi subsurface stresses are obtained by peening with the following parameters:

1. 330 hard (i.e., 56 $R_c$) steel shot;
2. about 20 feet per second shot velocity; and
3. a peening intensity of about 0.007 Almen C and most preferably 0.0075 or more.

Gears so made have demonstrated fatigue lives equal to and surpassing that of their carburized steel counterparts. More specifically, hypoid gears (i.e., 8.75 inches pitch diameter ring gears) have been tested in automobile differentials under loading extremes and have survived between about 150,000 to 228,000 miles per gear set without failure. FIGS. 2–4 show one such hypoid gear set 1, austempered as exemplified above, including its microstructure at various locations. The Figures show that the percentage of acicular bainite formed throughout the cross section of the parts varies with depth and the thickness of the casting. FIG. 3 shows that for the thinner-sectioned ring gear 2, a 50% or more acicular bainite matrix prevails substantially throughout the gear. FIG. 4 shows that for the thicker sectioned pinion gear 3, a 50% or more bainite matrix prevails in the outermost base portion 4 directly beneath the teeth, while a small, irregularly shaped central base portion 5 has a lesser amount thereof due to the slower cooling rate experienced thereat during the austempering quench. The precise size and shape of the small central portion 5 is not material as it does not detract from the strength-giving outermost portion 4 and accordingly appears in FIG. 4 as only an illustrated estimate indicative only of its approximate size and location.

While this invention has been described primarily in terms of specific embodiments thereof, it is not intended to be limited to those embodiments but rather only to the extent set forth in the claims which follow.

The embodiments of the invention in which an exclusive property or privilege is claimed are defined as follows:

1. A process for making a through hardened, compressively surface stressed nodular iron gear capable of withstanding applied tooth root tensile stress excursions of at least about 60,000 psi without fatigue failure, said process comprising the sequential steps of:

casting a gear blank from nodular iron;

annealing the blank to yield a substantially homogeneous matrix microstructure upon cooling;

cooling the blank to room temperature;

machining teeth into the blank;

heating the machined casting in a nonoxidizing atmosphere to a temperature of about 1600° F. to about 1700° F. to austenitize the matrix and dissolve sufficient uncombined carbon to provide an austenitic phase comprising about 0.7% to about 1.1% dissolved carbon;

quenching the casting to an isothermal transformation temperature of above about 425° F. and below about 650° F. and at such a rate as to avoid the nose of the time-temperature transformation curve of the nodular iron so as to preclude the formation of significant amounts of pearlite, feathery bainite or martensite prior to and during subsequent isothermal transformation at said quenching temperature;

maintaining the casting at said isothermal transformation temperature for a time sufficient to convert said austenitic phase to at least 50% acicular bainite;

cooling said casting from said isothermal transformation temperature to room temperature; and shot peening the surface of the gear at the roots of the gear's teeth to impart to said surface a residual compressive stress of at least about 40,000 psi and provide a residual compressive stress of about 10,000 psi at a depth of about 0.006 inch to about 0.015 inch beneath the surface.

2. A process for making a through hardened, compressively surface stressed nodular iron gear capable of withstanding applied tooth root tensile stress excursions of at least about 60,000 psi without fatigue failure, said process comprising the sequential steps of:

casting a gear blank from nodular iron; heating the blank for a time and at a temperature sufficient to dissolve combined carbon and yield a substantially homogeneous matrix microstructure containing at least about 65% ferrite upon cooling;

cooling the blank to room temperature;

machining teeth into the blank;

heating the machined casting in a nonoxidizing atmosphere to a temperature of about 1600° F. to about 1700° F. to austenitize the matrix and dissolve sufficient uncombined carbon to provide an austenitic phase comprising about 0.7% to about 1.1% dissolved carbon;

quenching the casting to an isothermal transformation temperature of above about 425° F. and below about 650° F. and at such a rate as to avoid the nose of the time-temperature transformation curve of the nodular iron so as to preclude the formation of significant amounts of pearlite, feathery bainite or martensite prior to and during subsequent isothermal transformation at said quenching temperature;

maintaining the casting at said isothermal transformation temperature for a time sufficient to convert said austenitic phase to at least 50% acicular bainite;

cooling said casting from said isothermal transformation temperature to room temperature; and shot peening the surface of the gear at the roots of the gear's teeth to impart to said surface a residual compressive stress of at least about 40,000 psi and provide a residual compressive stress of about 10,000 psi at a depth of about 0.006 inch to about 0.015 inch beneath the surface.

3. A process for making a through hardened, compressively surface nodular iron gear capable of withstanding applied tooth root tensile stress excursions of at least about 73,000 psi without fatigue failure, said process comprising the sequential steps of:

casting a gear blank from nodular iron; heating the blank to above the eutectoid temperature for a time sufficient to austenitize the blank, dissolve any nonpearlitic cemetite and homogenize the microstructure of the matrix;

slowly cooling the blank down through the eutectoid temperature at a rate less than about 100° F. per hour to yield a homogeneous matrix comprising about 65% by weight or more ferrite;

machining teeth into the blank;

heating the machined casting in a non-oxidizing atmosphere to a temperature of about 1650° F. to austenitize the matrix and dissolve sufficient uncombined carbon to provide an austenitic phase comprising about 0.8% to about 1.1% dissolved carbon;

quenching the casting to an isothermal transformation temperature of about 455° F. and at a rate of at least about 66° F. per second so as to avoid the nose of the time-temperature transformation curve of the nodular iron and thereby preclude the formation of significant amounts of pearlite, feathery bainite or martensite prior to and during subsequent isothermal transformation at said quenching temperature;

maintaining the casting at said isothermal transformation temperature for a time sufficient to convert said austenitic phase to at least about 65% acicular bainite;

cooling said casting from said isothermal transformation temperature to room temperature; and shot peening the surface of the gear teeth to impart to said surface at the roots of the teeth a residual compressive stress of at least about 40,000 psi and less than about 85,000 psi and provide a residual compressive stress of about 10,000 psi at a depth of about 0.008 inch to about 0.013 inch beneath the tooth root surface.

4. A through hardened, high stress gear capable of withstanding occasional applied tooth root tensile stress excursions of at least about 60,000 psi, said gear comprising a base portion and a plurality of teeth integral with and extending from said base portion, said teeth each comprising a central core and a skin cold worked by impingement on said core at least at the tooth's root where it joins the base, said base, core and skin comprising nodular iron the matrix of which comprises at least about 50% by weight non-feathery acicular bainite having a dissolved carbon content of about 0.7% to about 1.1% by weight and a Vickers hardness between about 577 and 720, and said skin having a residual compressive stress of at least about 40,000 psi at its surface and about 10,000 psi at a depth between about 0.006 inch and 0.015 inch below said surface.

5. A through hardened high stress gear capable of withstanding occasional applied tooth root tensile stress excursions of at least about 73,000 psi, said gear comprising a base portion and a plurality of teeth integral with and extending from said base portion at the tooth roots, said teeth each comprising a central core portion and a skin cold worked by impingement on said core, said base, core and skin comprising nodular iron the matrix of which comprises at least about 65% by weight non-feathery acicular bainite having a dissolved carbon content of about 0.8% to about 1.0% by weight and a Vickers hardness between about 613 and 720, and said skin at said roots having a residual compressive stress of between about 40,000 psi and 85,000 psi at its surface and about 10,000 psi at a depth between about 0.008 inch and 0.013 inch below said surface.

6. A through hardened high stress automotive drive hypoid gear set comprising a ring and pinion gear, said ring gear being capable of withstanding occasional applied tooth root tensile stress excursions of at least about 90,000 psi, and said pinion gear being capable of withstanding occasional applied tooth root tensile stress excursions of at least about 73,000 psi, said gears each comprising a base portion and a plurality of teeth integral with and extending from said base portion at the tooth roots, said teeth each comprising a central core portion and a skin cold worked by impingement on said core, said base, core and skin comprising nodular iron the matrix of which comprises at least about 65% by weight non-feathery acicular bainite having a dissolved carbon content of about 0.8% to about 1.0% by weight and a Vickers hardness between about 613 and 720, and said skin at said roots having a residual compressive stress of between about 40,000 psi and 85,000 psi at its surface and about 10,000 psi at a depth between about 0.008 inch and 0.013 inch below said surface.

* * * * *

UNITED STATES PATENT AND TRADEMARK OFFICE

CERTIFICATE OF CORRECTION

PATENT NO. : 4,222,793

DATED : September 16, 1980

INVENTOR(S) : Robert B. Grindahl

It is certified that error appears in the above-identified patent and that said Letters Patent are hereby corrected as shown below:

Column 1, line 63, after "entirely", insert -- on carburized steel for these drive gear sets because --.

Column 5, line 37, "445°" should read -- 455° --.

Column 7, line 43, after "surface", insert -- stressed --.

Column 7, line 50, "cemetite" should read -- cementite --.

Signed and Sealed this

Eighth Day of September 1981

[SEAL]

Attest:

GERALD J. MOSSINGHOFF

Attesting Officer

Commissioner of Patents and Trademarks